US009206674B2

(12) United States Patent
Luke

(10) Patent No.: US 9,206,674 B2
(45) Date of Patent: Dec. 8, 2015

(54) APPARATUS AND METHODS OF RUNNING AN EXPANDABLE LINER

(71) Applicant: Weatherford/Lamb, Inc., Houston, TX (US)

(72) Inventor: Mike A. Luke, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 321 days.

(21) Appl. No.: 13/786,195

(22) Filed: Mar. 5, 2013

(65) Prior Publication Data

US 2013/0228344 A1 Sep. 5, 2013

Related U.S. Application Data

(60) Provisional application No. 61/727,407, filed on Nov. 16, 2012, provisional application No. 61/606,857, filed on Mar. 5, 2012.

(51) Int. Cl.

| | |
|---|---|
| ***E21B 43/10*** | (2006.01) |
| ***E21B 33/14*** | (2006.01) |
| ***E21B 21/10*** | (2006.01) |

(52) U.S. Cl.

CPC ..... *E21B 43/103* (2013.01); *E21B 21/10* (2013.01); *E21B 33/14* (2013.01); *E21B 43/105* (2013.01)

(58) Field of Classification Search

CPC ..... E21B 43/105; E21B 43/103; E21B 34/14; E21B 43/10; E21B 17/06; E21B 43/108; E21B 43/106

See application file for complete search history.

(56) References Cited

U.S. PATENT DOCUMENTS

| | | | | |
|---|---|---|---|---|
| 4,911,237 | A | 3/1990 | Melenyzer | |
| 5,086,843 | A | 2/1992 | Mims et al. | |
| 5,086,844 | A | 2/1992 | Mims et al. | |
| 5,170,847 | A | 12/1992 | Mims et al. | |
| 5,174,375 | A | 12/1992 | Mims et al. | |
| 5,794,694 | A | 8/1998 | Smith, Jr. | |
| 6,053,244 | A | 4/2000 | Dybevik et al. | |
| 6,241,018 | B1 | 6/2001 | Eriksen | |
| 6,648,075 | B2 | 11/2003 | Badrak et al. | |
| 7,426,964 | B2 | 9/2008 | Lynde et al. | |
| 8,132,619 | B2 * | 3/2012 | Smith et al. | 166/207 |
| 8,286,717 | B2 | 10/2012 | Giroux et al. | |
| 2002/0070032 | A1 | 6/2002 | Maguire et al. | |
| 2004/0231855 | A1 * | 11/2004 | Cook et al. | 166/378 |
| 2005/0006106 | A1 | 1/2005 | Hirth et al. | |
| 2005/0051342 | A1 * | 3/2005 | Campbell et al. | 166/380 |
| 2006/0196678 | A1 * | 9/2006 | Connell et al. | 166/380 |
| 2010/0155084 | A1 | 6/2010 | Watson et al. | |

(Continued)

OTHER PUBLICATIONS

PCT Invitation to Pay Additional Fees with Partial International Search Report, dated Apr. 30, 2014, for International Application No. PCT/US2013/029209.

(Continued)

*Primary Examiner* — Blake Michener
*Assistant Examiner* — Kipp Wallace
(74) *Attorney, Agent, or Firm* — Patterson & Sheridan, L.L.P.

(57) ABSTRACT

An apparatus for carrying and releasing a liner downhole includes a tubular body; a latching member attached to the tubular body for coupling with the liner; and a release sleeve disposed between the tubular body and the latching member, wherein the release sleeve is axially movable relative to the tubular body to allow the latching member to disengage from the liner.

6 Claims, 18 Drawing Sheets

(56) References Cited

U.S. PATENT DOCUMENTS

| | | | |
|---|---|---|---|
| 2011/0036594 | A1 | 2/2011 | Yokley et al. |
| 2011/0132622 | A1 | 6/2011 | Moeller et al. |
| 2011/0132623 | A1 | 6/2011 | Moeller |

OTHER PUBLICATIONS

PCT International Search Report and Written Opinion for Application PCT/US2013/029209, dated Jul. 4, 2014.

* cited by examiner

A-A

APPARATUS AND METHODS OF RUNNING AN EXPANDABLE LINER

BACKGROUND OF THE INVENTION

1. Field of the Invention

The present invention generally relates to an apparatus and method for completing a wellbore. More particularly, the invention relates to an apparatus and method for expanding a tubular body in a wellbore. More particularly still, the invention relates to an apparatus and method for carrying a longer string of expandable tubular body in a wellbore.

2. Description of the Related Art

In well completion operations, a wellbore is formed to access hydrocarbon-bearing formations by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using an apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with a drill bit on a drill string. The drill string is removed. A first string of casing or conductor pipe is then run into the wellbore and set in the drilled out portion of the wellbore, and cement is circulated into the annulus behind the casing string. Next, the well is drilled to a second designated depth, and a second string of casing, or liner, is run into the drilled out portion of the wellbore. The second string is set at a depth such that the upper portion of the second string of casing overlaps the lower portion of the first string of casing. The second liner string is then fixed, or "hung" off of the existing casing by the use of slips which utilize slip members and cones to wedgingly fix the new string of liner in the wellbore. The second casing string is then cemented. This process is typically repeated with additional casing strings until the well has been drilled to total depth. As more casing strings are set in the wellbore, the casing strings become progressively smaller in diameter in order to fit within the previous casing string. In this manner, wells are typically formed with two or more strings of casing of an ever-decreasing diameter.

Decreasing the diameter of the wellbore produces undesirable consequences. Progressively decreasing the diameter of the casing strings with increasing depth within the wellbore limits the size of wellbore tools which are capable of being run into the wellbore. Furthermore, restricting the inner diameter of the casing strings limits the volume of hydrocarbon production fluids which may flow to the surface from the formation.

In the last several years, methods and apparatus for expanding the diameter of casing strings within a wellbore have become more common. For example, a string of liner can be hung in a well by placing the upper portion of a second string of casing in an overlapping arrangement with the lower portion of a first string of casing. The second string of casing is then expanded into contact with the existing first string of casing with an expander tool. The second string of casing is then cemented.

An exemplary expander tool utilized to expand the second casing string into the first casing string is fluid powered and run into the wellbore on a working string. The hydraulic expander tool includes radially expandable members which, through fluid pressure, are urged outward radially from the body of the expander tool and into contact with the second casing string therearound. As sufficient pressure is generated on a piston surface behind these expansion members, the second casing string being acted upon by the expansion tool is expanded past its point of elastic deformation. In this manner, the inner and outer diameter of the expandable tubular is increased in the wellbore. By rotating the expander tool in the wellbore and/or moving the expander tool axially in the wellbore with the expansion member actuated, a tubular can be expanded into plastic deformation along a predetermined length in a wellbore.

In one application, running tools used to expand the liner downhole typically support the liner weight on the face of the expander cone while running in the hole. This limits the maximum length of liner that can be run because the expansion cone shape is not designed to carry the liner. Rather, the expansion cone has a weight distribution and strength profile that enables the expansion cone to slide through the liner easily without being deformed. In addition to the risks involving the expansion cone, the running tool may prematurely shift and expand the liner. These design and operation problems lead to running shorter than desired lengths of liner.

This problem has been addressed by increasing the effective wall thickness of the liner at the support point against the expansion cone face to prevent yielding. However, the expansion cone has to apply more expansion force to expand a thicker liner wall. The increased tubular pressure may cause damage to other portions of the liner. As a result, this method is limited by the internal pressure rating of the expandable liner or its connections, and therefore, is still inadequate to provide the desired length of liner.

There is a need, therefore, for a reliable running and release mechanism to carry longer and heavier liners while running in the hole.

SUMMARY OF THE INVENTION

In one embodiment, an apparatus for carrying and releasing a liner downhole includes a tubular body; a latching member attached to the tubular body for coupling with the liner; and a release sleeve disposed between the tubular body and the latching member, wherein the release sleeve is axially movable relative to the tubular body to allow the latching member to disengage from the liner.

In another embodiment, a method of carrying and releasing a liner downhole includes providing a release apparatus having a release sleeve and a latching profile coupled to a tubular body; coupling the latching profile to the liner; using the release sleeve to maintain engagement of the latching profile to the liner; lowering the release apparatus and the liner downhole; and axially moving the release sleeve relative to the latching profile and the tubular body to allow the latching member to disengage from the liner. In one embodiment, the tubular body remains stationary relative to the liner during axial movement of the release sleeve.

In yet another embodiment, a system for expanding a liner includes a tubular body; a latching member having a latching profile engaged to a mating profile of the liner; a release sleeve disposed around the tubular body and operable to allow the latching member to retract from the liner; and an expander coupled to the tubular body for expanding the liner.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention is generally directed to a method and apparatus for lining a wellbore using an expandable liner system.

An expandable tubular assembly includes an expander for expanding a tubular. The expander may be hydraulically actuated using a bore obstruction object. The bore obstruction object may be received in a receptacle sleeve that is a modular component of the expandable tubular assembly. In this respect, the expandable tubular assembly may be quickly fitted with a receptacle sleeve designed to receive a selected type of bore obstruction object. The modular aspect of the receptacle sleeve provides versatility to the expandable tubular assembly during manufacturing and use at the worksite. For example, the expandable tubular system may be configured to receive two darts or a ball simply by changing the receptacle sleeve.

Figure 1:
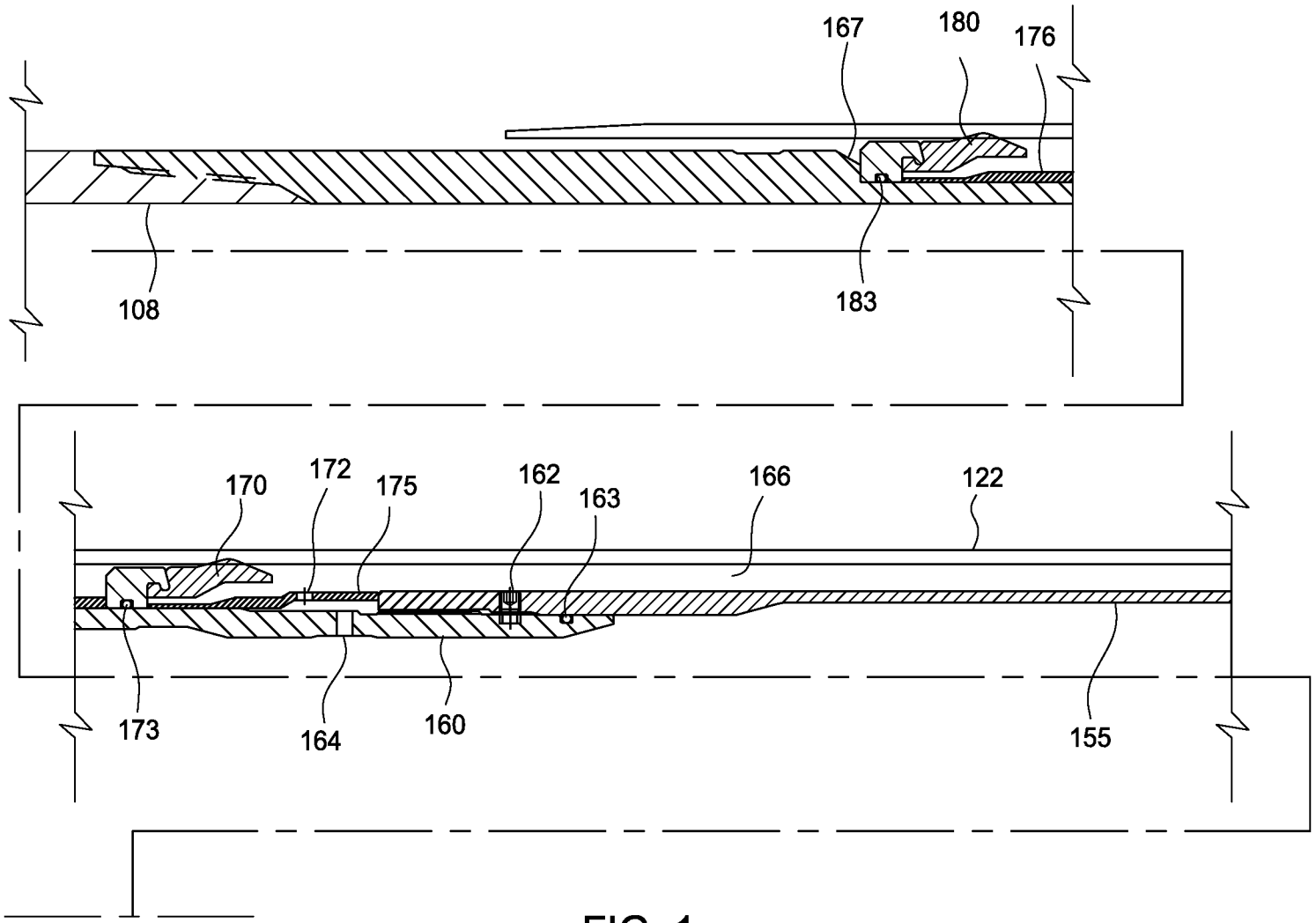
FIG. 1 is a cross-sectional view illustrating an exemplary embodiment of an expandable tubular system.

FIG. 1 is a cross-sectional view of an expandable liner system 100 having an expandable tubular 125 and an expansion assembly 150. The expandable liner system 100 may be used to position and expand the expandable tubular 125 in a wellbore, which may be cased or open hole. For example, an upper portion of the expandable tubular 125 may be placed in an overlapping relationship with a lower portion of a previously existing casing. Thereafter, the expansion assembly 150 is employed to expand the expandable tubular 125 inside the casing and the surrounding wellbore.

As shown in FIG. 1, the expandable liner system 100 has a lower nose portion which includes a lower nose end 130 attached to a tubular body section 135. The lower nose end 130 may be rounded to facilitate insertion into the wellbore. The lower end 130 of the expandable tubular 125 is connected to the tubular body section 135. A bore 133 allows fluid flow through the lower nose end 130, the tubular body section 135, and the expandable tubular 125. A valve 140 is disposed inside the bore 133 to control fluid flow therethrough. The valve 140 may be a one way valve which allows the outflow of fluid, but prevents the inflow of fluid. In the embodiment shown in FIG. 1, the valve 140 is an auto-fill valve which allows the expandable tubular 125 to fill with fluid while running in the hole. The filling function may be deactivated by circulating fluid above a predetermined flow rate. Thereafter, the plunger 141 of the valve 140 is biased toward a sealing surface 142 on the tubular body section 135. The direction of the bias prevents fluid from flowing back into the expandable tubular 125. In another embodiment, the lower nose end may include a rotatable section having an eccentric shape. The rotatable section may facilitate the run-in of the expandable liner system 100. In the event an obstruction is encountered, the eccentric shape allows the rotatable section to rotate away from the obstruction, thereby continuing the run-in of the liner system 100 to the predetermined depth. An exemplary lower nose end is a free-rotating eccentric guide shoe commercially available from Weatherford International. In another embodiment, the lower nose end may be any suitable float shoe device, with or without a valve.

The expandable tubular 125 includes an enlarged portion 121 and an unexpanded portion 122. The enlarged portion 121 may be attached to the tubular body section 135 using a threaded connection. A seal 127 such as an o-ring may be disposed between the enlarged portion 121 and the tubular body section 135 to prevent fluid blow therebetween. In one embodiment, the enlarged portion 121 has an outer diameter that is substantially the same as the outer diameter of the lower nose end 130.

Figures 1, 1A:
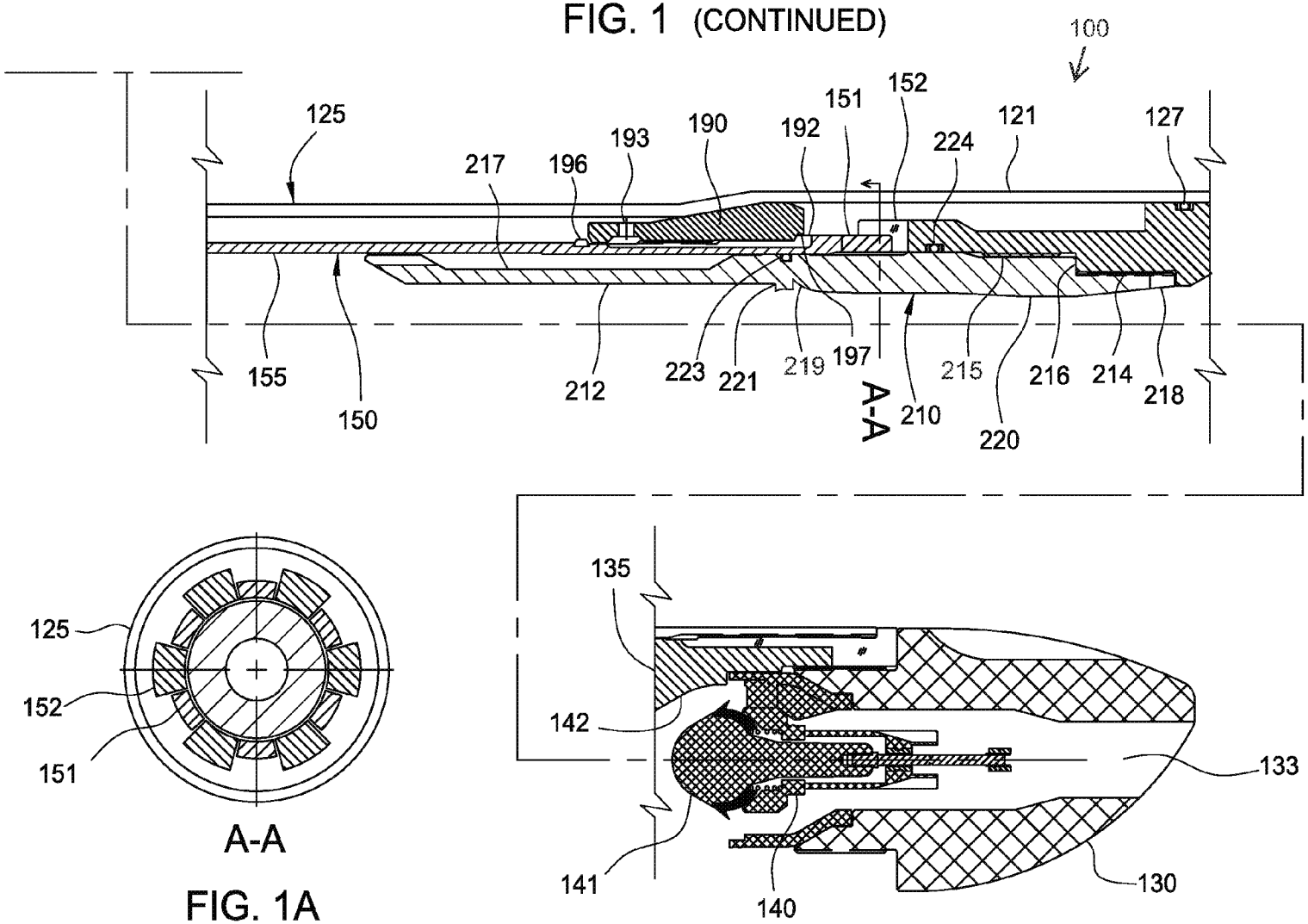
FIG. 1A is transverse cross-sectional view of the expandable tubular system.

The expansion assembly 150 includes a mandrel 155 coupled to an upper end of the tubular body section 135. The mandrel 155 may be coupled to the tubular body section 135 using a connection that allows the mandrel 155 to move axially relative to the tubular body section 135 and to transfer torque to the tubular body section 135. As shown, the mandrel 155 is coupled to the tubular body section 135 using castellations 151 formed at the lower end of the mandrel 155 and mating castellations 152 formed at the upper end of the tubular body section 135. FIG. 1A is a cross-sectional view showing the coupling of the castellations 151, 152 of the mandrel 155 and the tubular body section 135.

The upper end of the mandrel 155 is connected to an adapter sleeve 160, which may be connected to a running string 108, such as a drill pipe string, from the surface. For example, the mandrel 155 may be threadedly connected to the adapter sleeve 160. In another embodiment, the mandrel 155 may attach directly to the running string 108. A torque connector 162 such as a torque screw may be used to couple the mandrel 155 to the adapter sleeve 160 to allow rotation in either direction. A seal 163 is disposed between the adapter sleeve 160 and the mandrel 155. The adapter sleeve 160 includes a port 164 to allow fluid communication between the bore 133 and the annular area 166 between the mandrel 155 and the expandable tubular 125. A packer 170 is coupled to the adapter sleeve 160 and is disposed in the annular area above the port. An exemplary packer is a cup packer. A spacer sleeve 175 may be used to retain the packer 170 in position and may include an opening 172 for fluid communication between the bore 133 and the exterior annular area 166. In one embodiment, the packer 170 is allowed to rotate relative to the adapter sleeve 160. A seal 173 such as an o-ring may be disposed between the packer 170 and the adapter sleeve 160.

In another embodiment, an optional second packer 180 may be disposed above the first packer 170. The second packer 180 may be disposed between a shoulder 167 on the adapter sleeve 160 and a second spacer sleeve 176 disposed above the first packer 170. A seal 183 such as an o-ring may be disposed between the second packer 180 and the adapter sleeve 160. The second packer 180 may be rotatable relative to the adapter sleeve 160. In the single packer configuration, the first packer 170 may be retained in position by positioning the second spacer sleeve 176 between the first packer 170 and the shoulder 167 or by positioning the first packer 170 adjacent the shoulder 167.

The expansion assembly 150 includes an expander 190 for expanding the expandable tubular 125. The expander 190 is attached to the exterior of the mandrel 155 and initially positioned at the transition between the enlarged portion 121 and the unexpanded portion 122 of the mandrel 155. The engagement between the expander 190 and the expandable tubular 125 is configured to provide support of the expandable tubular 125 during run-in. In one embodiment, the expander 190 may be a solid cone shaped expander. In another embodiment, the expander may be a multi-segmented cone expander. A bypass 192 between the expander 190 and the mandrel 155 allows fluid in the annular area 166 above the expander to communicate with the annular area 166 below the expander 190, and vice versa. In this respect, pressure above and below the expander 190 is allowed to equalize. In one embodiment, the bypass 192 may be a recessed channel formed on the exterior of the mandrel 155. In another embodiment, the bypass may be formed as a hole through the cone. As shown, optional expander ports 193 are provided to facilitate fluid communication through the expander 190. Optional upper limiter 196 and lower limiter 197 may be used to maintain the expander's 190 position with respect to the mandrel 155. In one embodiment, the upper limiter 196 and the lower limiter 197 may be selected from a c-ring or a shoulder.

The expandable liner system 100 may be configured for actuation by a variety of releasable bore obstruction objects. For example, the expansion process may be actuated using one or more bore obstruction objects such as a ball, a dart, a plug, and combinations thereof. The bore obstruction objects may be released from the surface or any portion of the running string above the expansion assembly 150 and allowed to land in the expansion assembly 150. In one embodiment, the expansion assembly 150 may include a receptacle member such as a receptacle sleeve configured to receive one or more of the bore obstruction objects. For example, the receptacle sleeve may be configured to receive a ball. In another example, the receptacle sleeve may be configured to receive two darts or a ball and a dart. The receptacle sleeve may be provided as a modular component of the expansion assembly 150 such that expansion assembly 150 may be quickly configured to receive a particular bore obstruction object by changing a particular receptacle sleeve designed to receive the selected bore obstruction object.

FIG. 1 shows the expansion assembly 150 equipped with an exemplary receptacle sleeve 210 configured to receive dart 206. The receptacle sleeve 210 includes a bore 212 to allow fluid communication therethrough. The lower end of the receptacle sleeve 210 includes threads 214 for connection to the tubular body section 135. The lower end may optionally include a shoulder section 216 for engagement with the tubular body section 135. The lower end may also include an optional second threaded section 215 for connection with the tubular body section 135. In another embodiment, the bottom of the receptacle sleeve 210 may include notches 218 which fall apart during drill out such that a ring is not formed at the bottom of the receptacle sleeve 210. A seal 223 such as an o-ring may be disposed between the receptacle sleeve 210 and the mandrel 155. The seal 223 may be positioned on the receptacle sleeve 210 or the mandrel 155. Another seal 224 may be disposed between the receptacle sleeve 210 and the tubular body section 135. The seal 224 may be positioned on the receptacle sleeve 210 or the tubular body section 135. The seals 223, 224, 127, 173, 163, and the packer 170 combine to define a sealed chamber between the mandrel 155 and the expandable tubular 125 that fluidly communicates through the opening 172 and the port 164. The receptacle sleeve 210 may optionally include recessed portions 217 to reduce amount of material that must be removed during drill out. The receptacle sleeve 210 may be any suitable length. In one embodiment, the receptacle sleeve 210 may be extended so that the dart 206 may be seated at a longer distance away from the nose 133. For example, the dart 206 may be seated at a position above the expander 190. In another example, the dart 206 may be seated at a distance that is at least two times the distance from the expander 190 to the lower nose end 130, for example, two times the distance, 5 times the distance, or ten times the distance. The longer bore distance is allowed to be filled with cement, which may be contaminated with drilling fluid or other material and prevented from exiting the nose 133.

Figure 2:
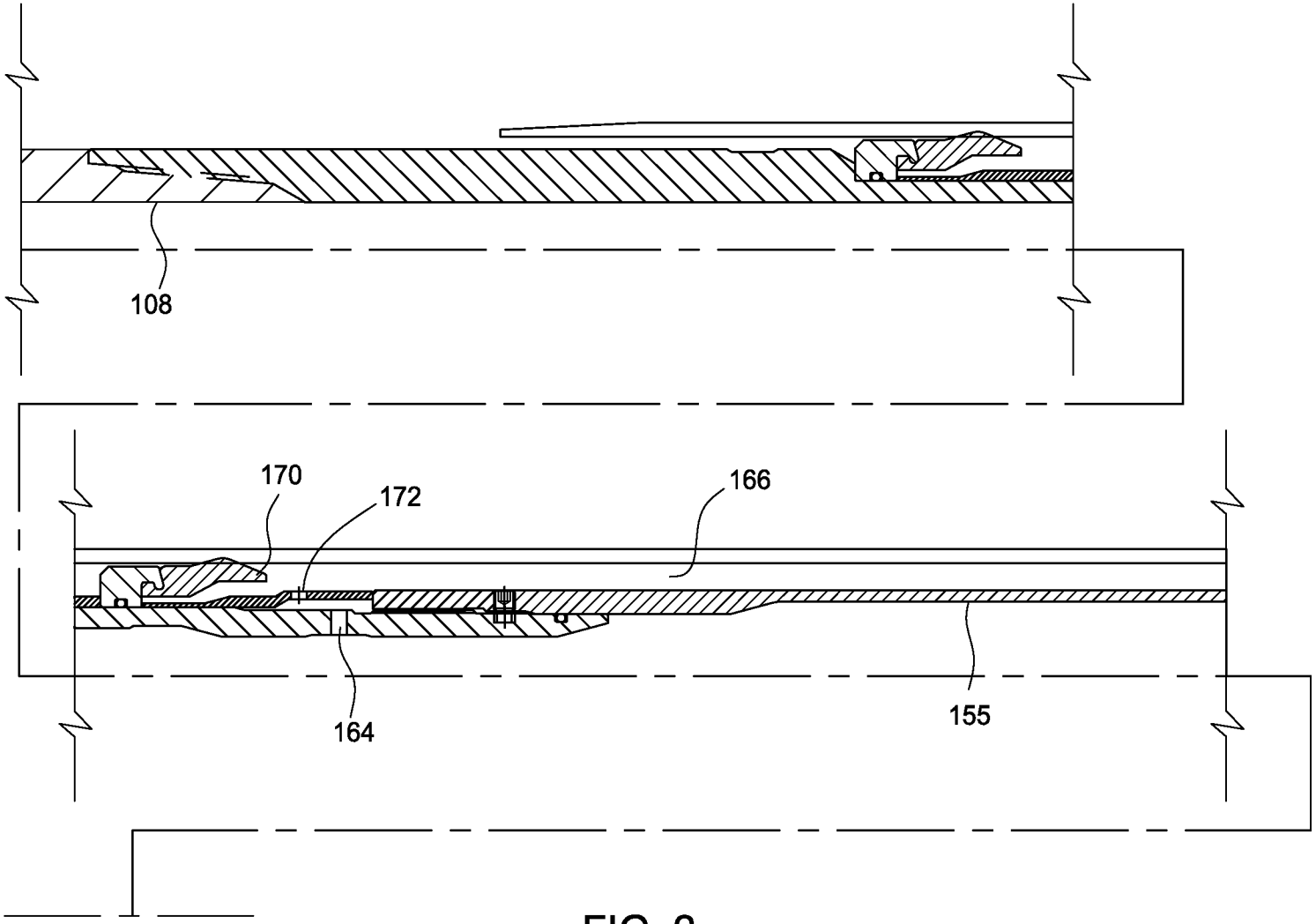
FIG. 2 is a cross-sectional view of the expandable tubular system of FIG. 1 after a dart has landed.
Figure 2:
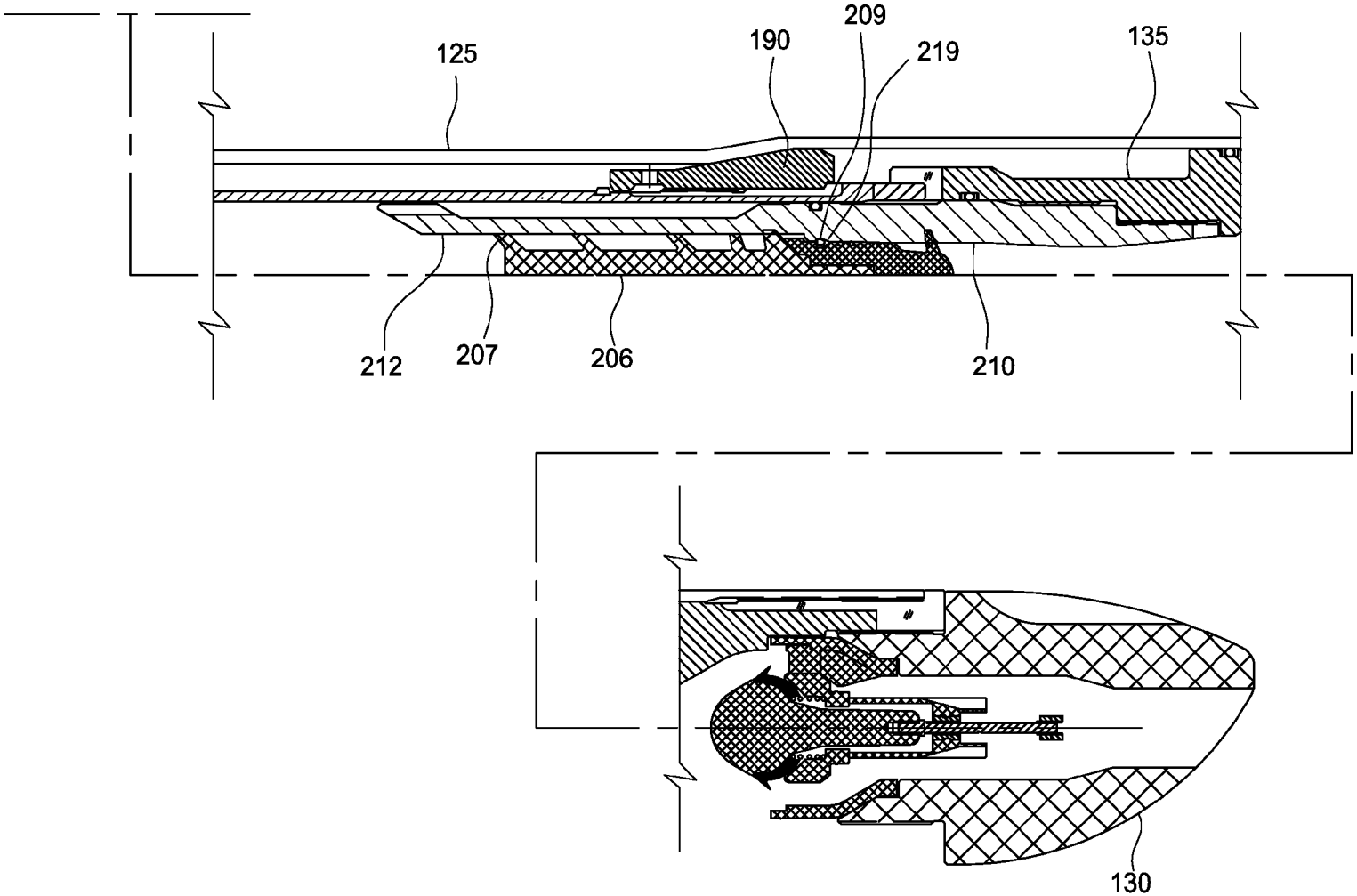

The bore 212 of the receptacle sleeve 210 is configured to receive one or more bore obstruction objects. As shown in FIG. 2, the bore 212 may be sized to receive a dart 206 and sealingly engage with a wiper 207 on the dart 206. The bore 212 may optionally include a shoulder 221 for engagement with a flange of the dart 206 to limit downward movement of the dart 206. Also, a latch 209 such as a c-ring may be provided on the dart 206 to engage a groove 219 in the bore 212 to limit upward movement of the dart 206. Optionally, the bore 212 may be configured to receive a ball. For example, the bore 212 include a smaller diameter section 220 located below the shoulder 221. In this manner, a ball having a diameter larger than the smaller diameter section 220 but smaller than the shoulder 221 may be allowed to pass the shoulder 221 and seat in the smaller diameter section 220. In one embodiment, the ball may be compressible such that is may be urged past the smaller diameter section 220 when sufficient pressure is applied.

Figure 3:
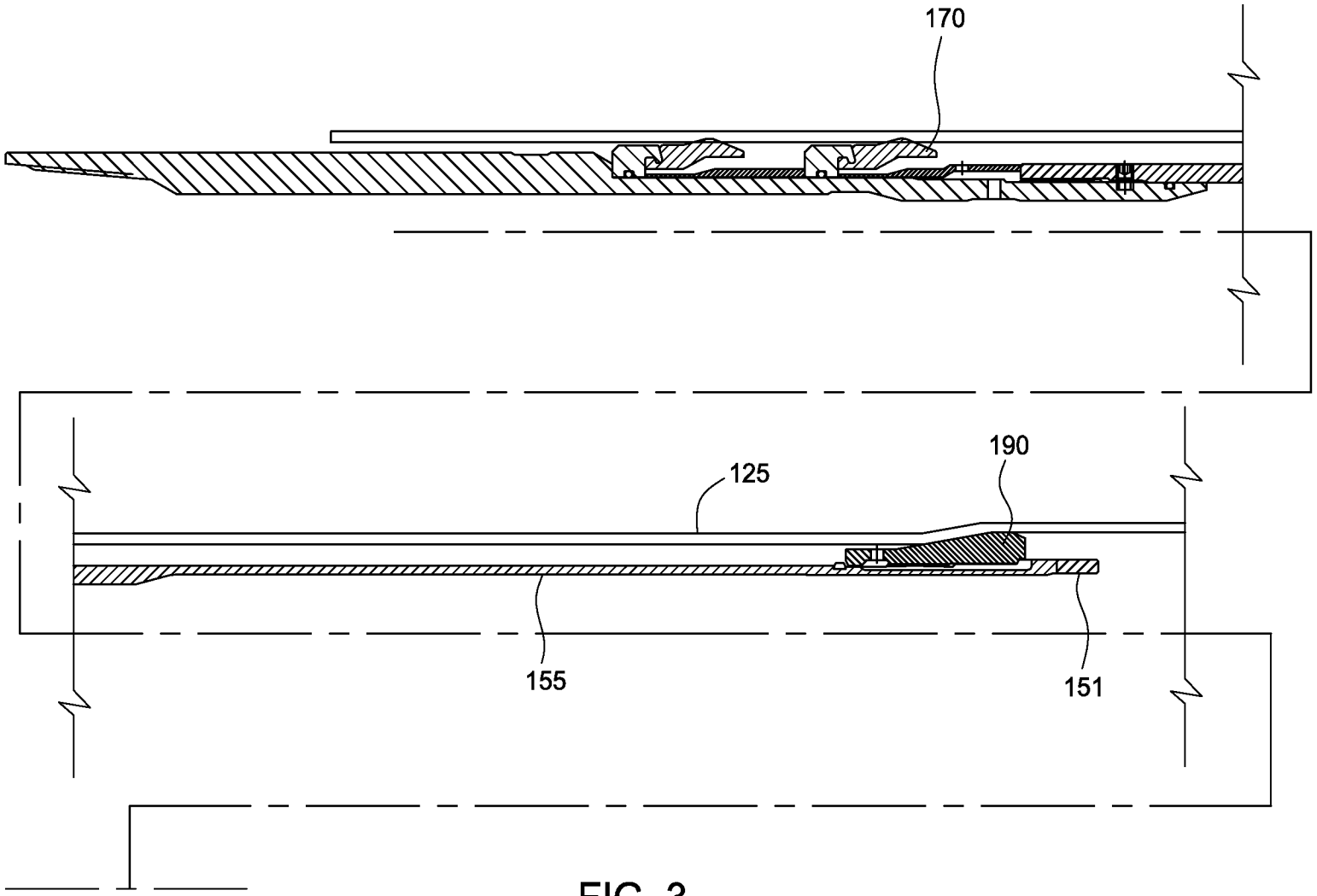
FIG. 3 is a cross-sectional view of the expandable tubular system of FIG. 1 during expansion.
Figure 3:
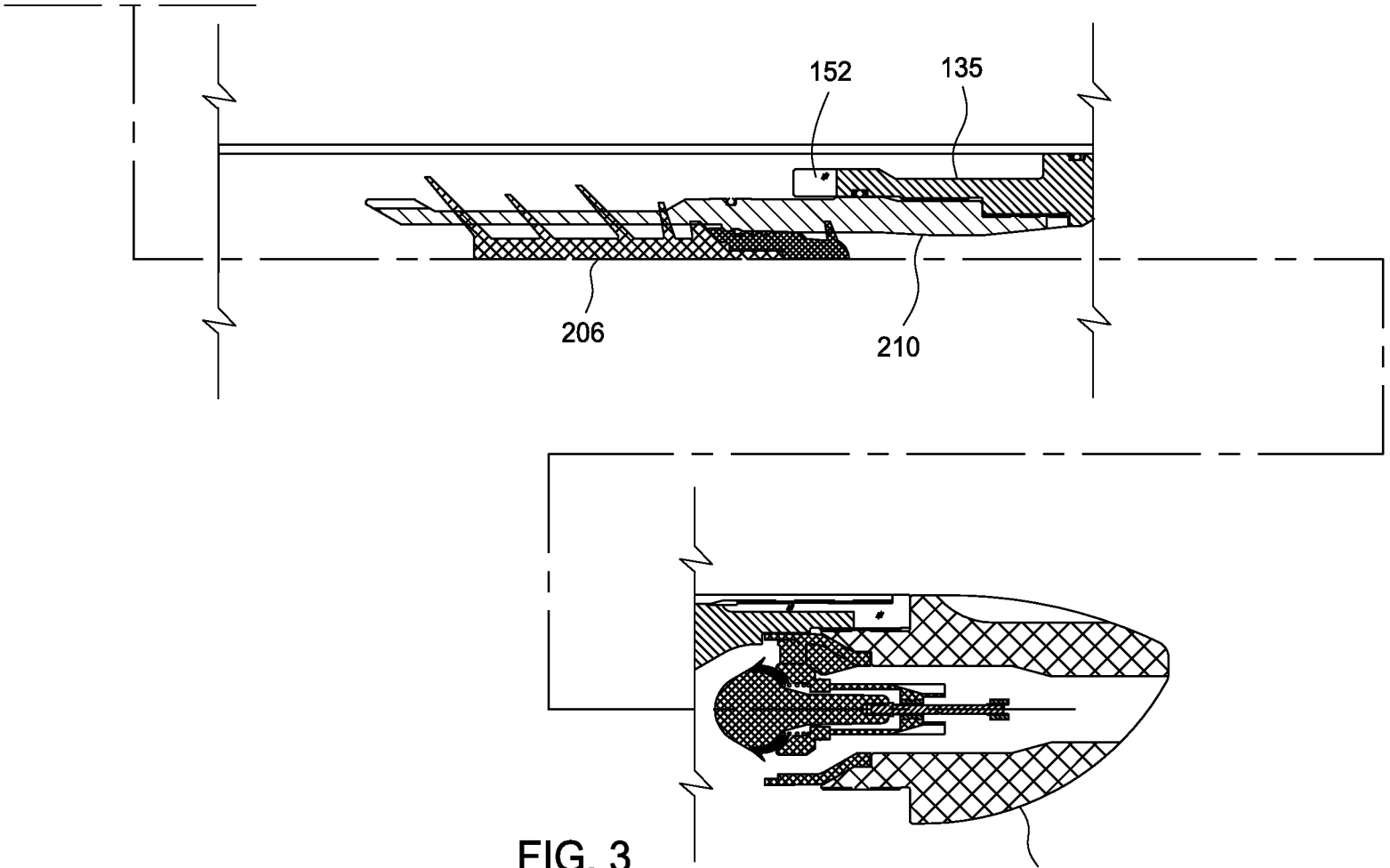

In one exemplary application, this embodiment may be used to expand a tubular in a vertical or horizontal where only one dart is released downhole. During operation, the expandable liner system 100 is lowered into the wellbore using a running string 108. The expansion assembly 150 is equipped with a receptacle sleeve 210 configured to receive the selected bore obstruction object. As shown in FIG. 1, the receptacle sleeve 210 is configured to receive a dart 206 and optionally a ball. To activate the expansion process, the dart 206 is dropped from the surface. In one embodiment, the dart 206 may be dropped after the cement. FIG. 2 shows the dart 206 has landed in the receptacle sleeve 210. It can be seen that the flange of the dart 206 has engaged the shoulder 221 of the receptacle sleeve 210, and the latch 209 has engaged the groove 219. In this position, the dart 206 prevents fluid communication through the bore 212 of the receptacle sleeve 210. Fluid is supplied to increase the pressure above the dart 206. The pressure is communicated to the sealed chamber via the port 164 and the opening 172. The increased pressure acts on the first packer 170 to urge the mandrel 155 and the expander 190 upward. The liner 125 is expanded as the expander 190 moves upward. FIG. 3 shows the expander 190 moving upward along the liner 125. Also, upward movement of the mandrel 155 causes its castellations 151 to disengage from the castellations 152 of the tubular body section 135. The mandrel 155 and the expander 190 may be removed after expansion. Thereafter, the dart 206, the receptacle sleeve 210, the tubular body section 135 and the nose 130 may be drilled out.

Figure 4:
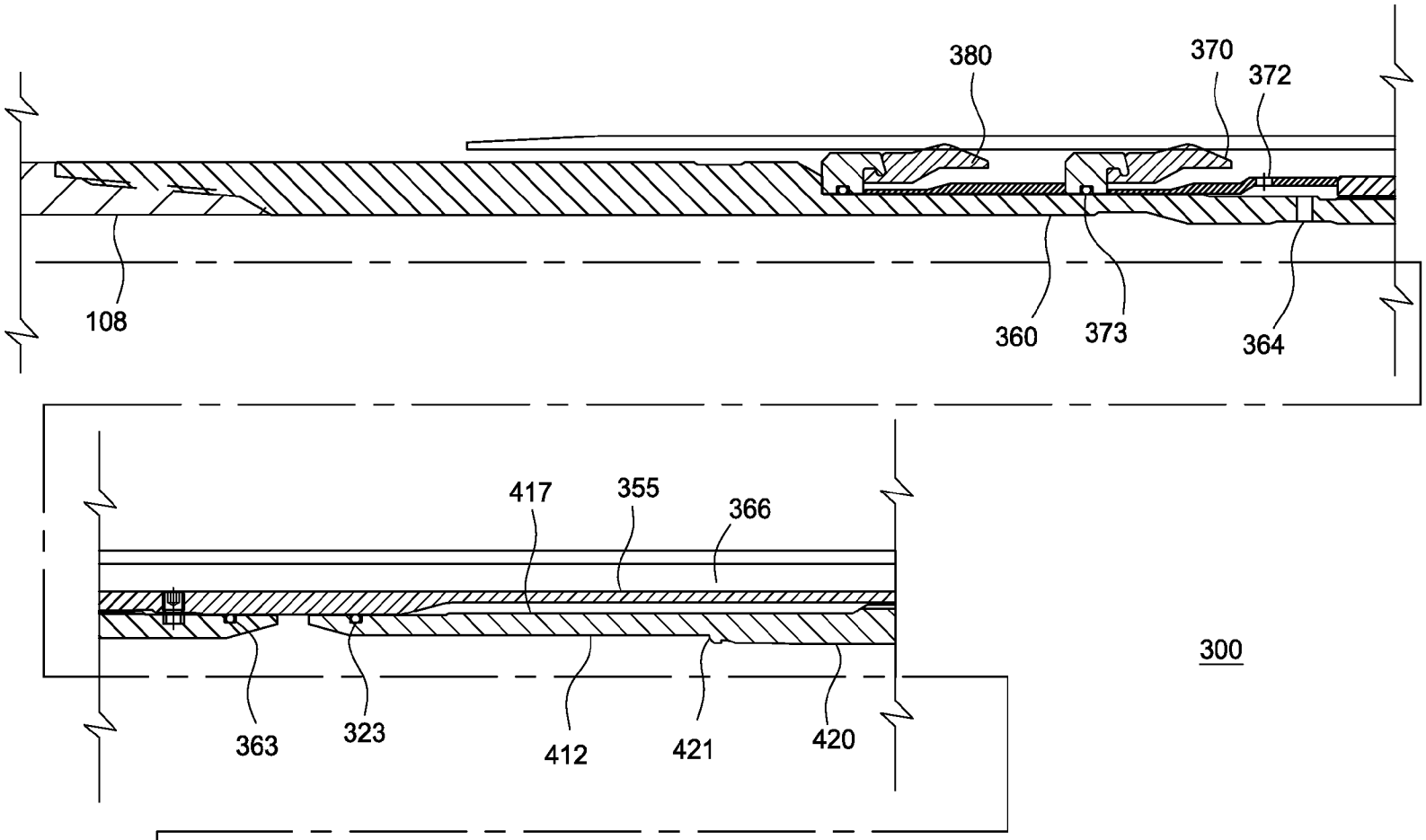
FIG. 4 is a cross-sectional view illustrating another exemplary embodiment of an expandable tubular system.
Figure 4:
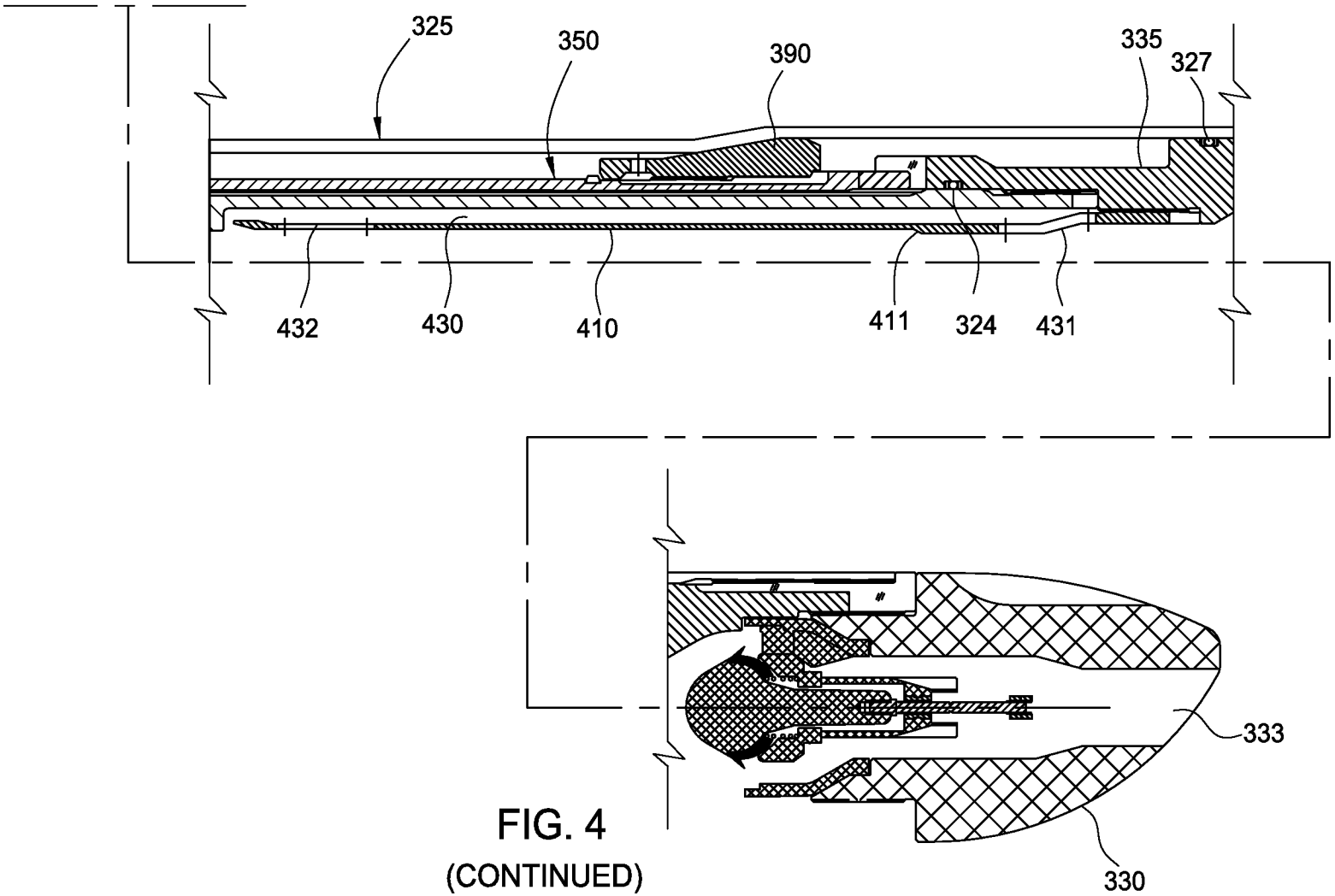

FIG. 4 illustrates an embodiment of expansion assembly 350 configured to receive two darts. Because the receptacle sleeve is provided as a modular component, the expansion assembly 350 may be quickly reconfigured by attaching the appropriate receptacle sleeve. In this respect, the mandrel 355 and the tubular body section 335 may remain substantially the same. To provide a clearer description, components shown in FIG. 4 that are previously presented in FIG. 1 will not be described again in detail.

As shown in FIG. 4, the expandable liner assembly 300 includes an expandable tubular 325 attached to the exterior of a tubular body section 335 and a nose 330 attached to the lower end of the tubular body section 335. A mandrel 355 is coupled to the tubular body section 335 and includes an expander 390 for expanding the tubular 325. A first packer 370 and an optional second packer 380 are coupled to the adapter sleeve 360, which in turn is connected to the upper end of the mandrel 355. The liner assembly 300 includes a first receptacle sleeve 410 connected to the tubular body section 335. The first receptacle sleeve 410 includes a seat 411 for receiving a first dart 416 (shown in FIG. 5). A second receptacle sleeve 420 is also connected to the tubular body section 335 and is located between the mandrel 355 and the first receptacle sleeve 410. The second receptacle sleeve 420 includes a seat 421 for receiving a second dart 426 (shown in FIG. 5). A seal 323 such as an o-ring may be disposed between the second receptacle sleeve 420 and the mandrel 355. The seal 323 may be positioned on the second receptacle sleeve 420 or the mandrel 355. Another seal 324 may be disposed between the second receptacle sleeve 420 and the tubular body section 335. The seal 324 may be positioned on the second receptacle sleeve 420 or the tubular body section 135. The seals 323, 324, 327, 373, 363, and the packer 370 combine to define a sealed chamber 366 between the mandrel 355 and the expandable tubular 325 that fluidly communicates through the opening 372 and the port 364. The second receptacle sleeve 420 may optionally include recessed portions 417 to reduce amount of material that must be removed during drill out. The second receptacle sleeve 420 may be any suitable length. In one embodiment, the second receptacle sleeve 420 may be extended so that the second dart 426 may be seated at a longer distance away from the nose 330. For example, the second dart 426 may be seated at a position above the expander 390. In another example, the second dart 426 may be seated at a distance that is at least two times the distance from the expander 390 to the nose 330, for example, two times the distance, five times the distance, or ten times the distance. The longer bore distance is allowed to be filled with cement, which may be contaminated with drilling fluid or other material and prevented from exiting the nose 330. The lower end of the first and second receptacle sleeves 410, 420 may include castellations to prevent the formation of rings during drill out.

The bore 412 of the second receptacle sleeve 420 may be sized to receive the second dart 426 and sealingly engage with a wiper 407 on the second dart 426. The seat 421 may engage with a flange of the second dart 426 to limit downward movement of the second dart 426. Also, a latch 409 such as a c-ring may be provided on the second dart 426 to engage a groove 419 in the bore 412 to limit upward movement of the second dart 426. The bore 412 is sufficiently sized to allow the first dart 416 to pass through and land in the seat 411 of the first receptacle sleeve 410. A cement bypass 430 is provided to allow the cement or other fluid to flow around the first dart 416 after landing. In one embodiment, openings 431, 432 are provided above and below the seat 411 to form the cement bypass 430.

Figure 5:
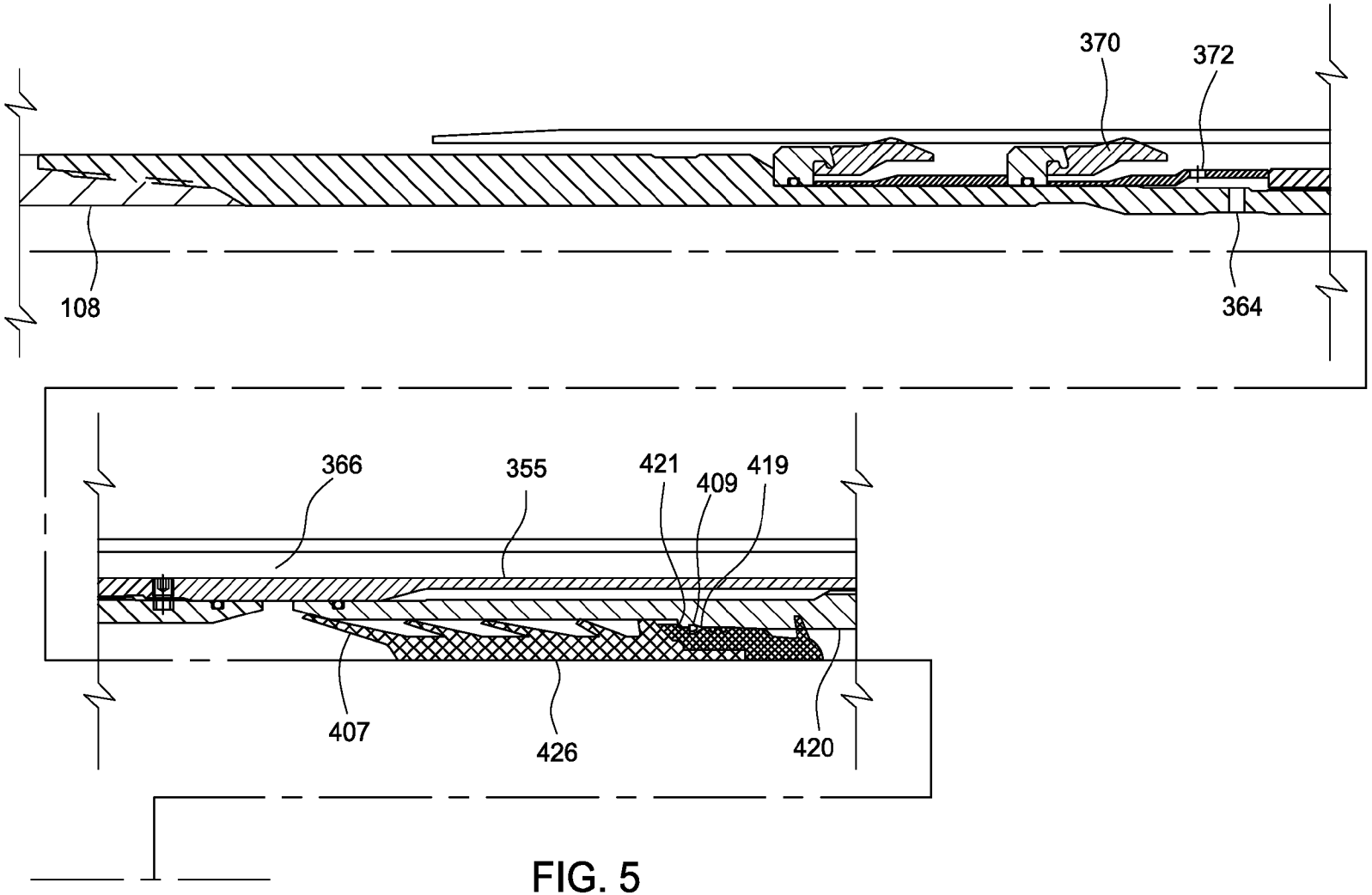
FIG. 5 is a cross-sectional view of the expandable tubular system of FIG. 4 after the darts have landed.
Figure 5:
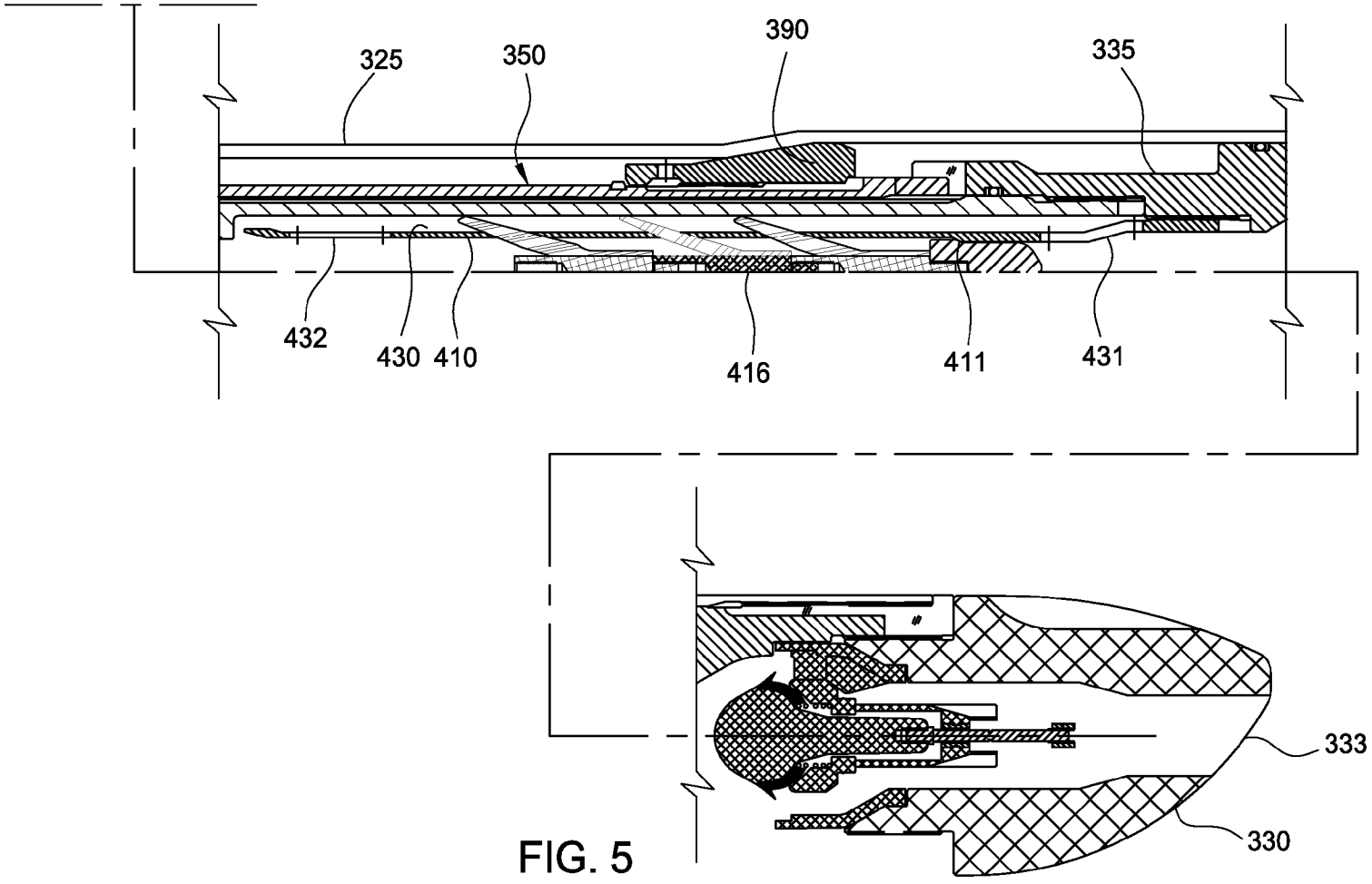

In one exemplary application, this embodiment may be used to expand a tubular in a vertical or horizontal wellbore where a conventional two dart system is selected. During operation, the expandable liner system 300 is lowered into the wellbore using a running string 108. The expansion assembly 350 is equipped with a first receptacle sleeve 410 and a second receptacle sleeve 420 to receive the first and second darts. Referring to FIG. 5, the first dart 416 is released into the wellbore to separate cement from the drilling fluid ahead of the cement. After the first dart 416 lands in the seat 411 of the first receptacle sleeve 410, cement is allowed to flow around first dart 416 via the cement bypass 430. After a sufficient amount of cement is supplied, a second dart 426 is released behind the cement to separate the cement from the drilling fluid behind the cement. Fluid communication through the bore 412 is blocked after the second dart 426 lands in the seat 421 of the second receptacle sleeve 410. FIG. 5 shows the first dart 416 and the second dart 426 after landing in their respective seats 411, 421. It can be seen that the flange of the second dart 426 has engaged the seat 421, and the latch 409 has engaged the groove 419. To activate the expansion process, fluid is supplied to increase the pressure above the second dart 426. The pressure is communicated to the sealed chamber 366 via the port 364 and the opening 372. The increased pressure acts on the first packer 370 to urge the mandrel 355 and the expander 390 upward. The liner 325 is expanded as the expander 390 moves upward. The mandrel 355 and the expander 390 may be removed after expansion. Thereafter, the first and second darts 416, 426, the first and second receptacle sleeves 410, 420, the tubular body section 335, and the nose 330 may be drilled out.

Figure 6:
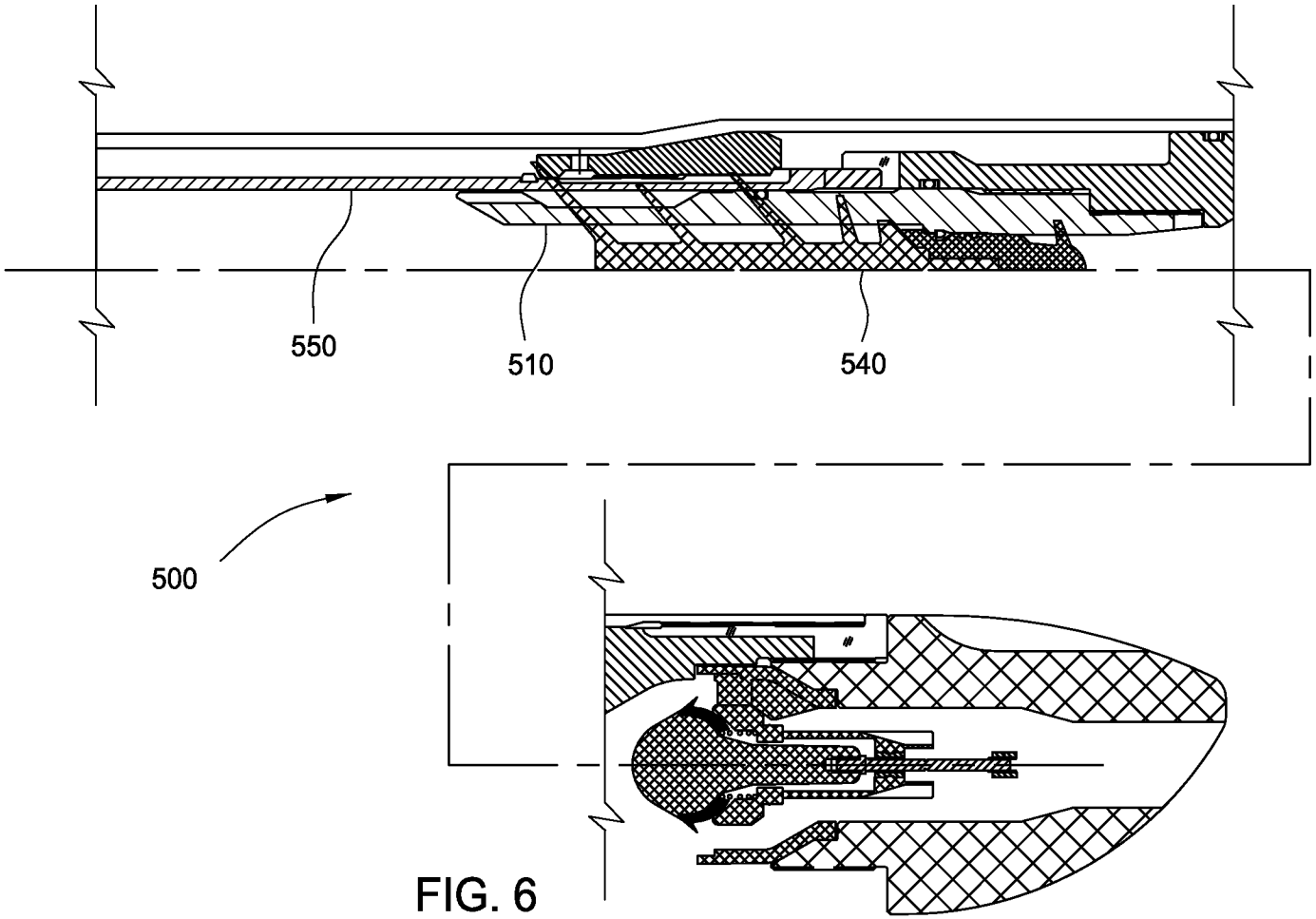
FIG. 6 is a partial cross-sectional view illustrating another exemplary embodiment of an expandable tubular system.

FIG. 6 illustrates another embodiment of the expandable liner assembly 500. The expansion assembly 550 is configured to receive a single dart 540. In comparison to the expansion assembly 150 of FIG. 1, the receptacle sleeve 510 is shorter in length and does not include the optional bore section for receiving a ball.

Figure 7:
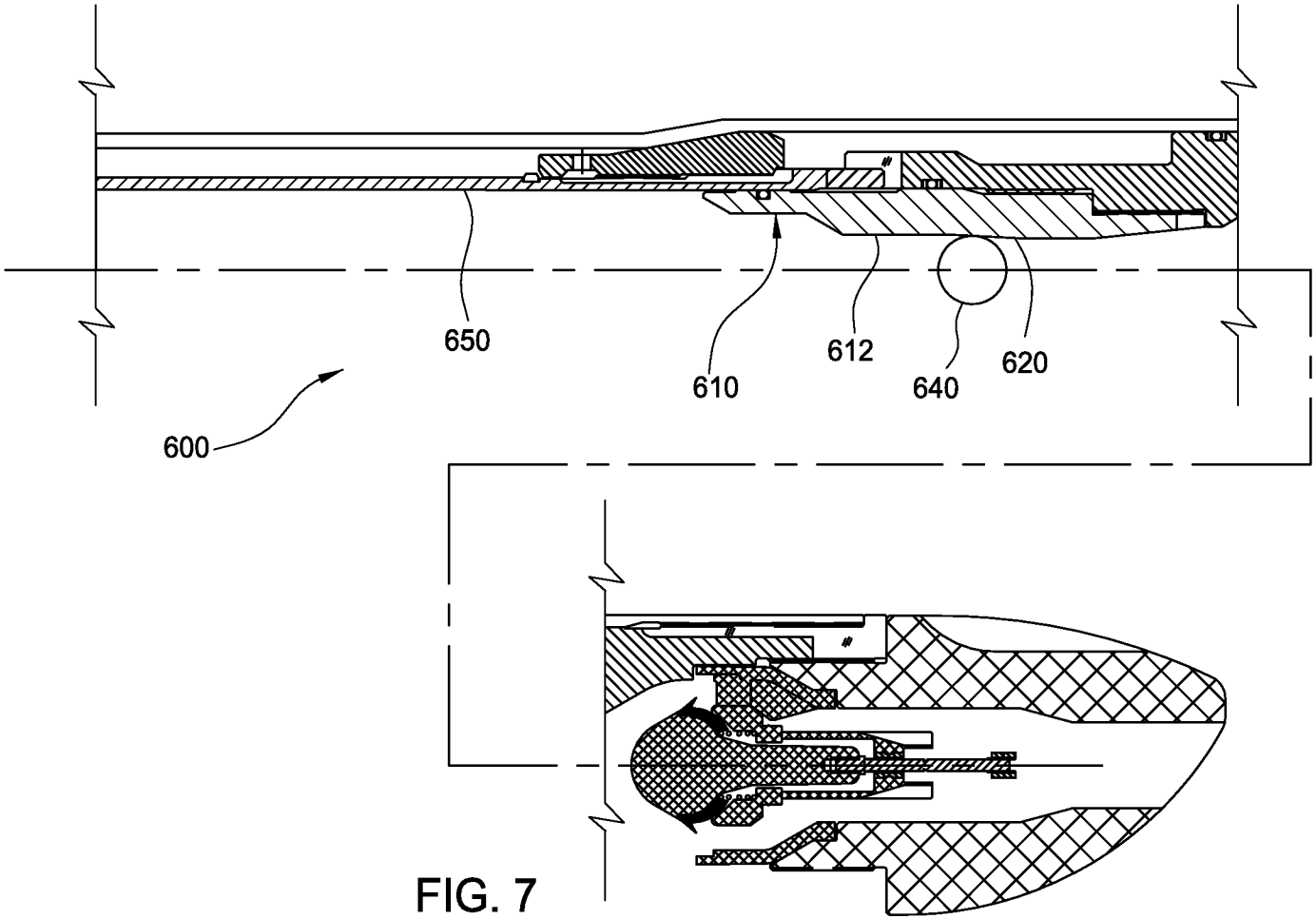
FIG. 7 is a partial cross-sectional view illustrating another exemplary embodiment of an expandable tubular system.

FIG. 7 illustrates another embodiment of the expandable liner assembly 600. The expansion assembly 650 is configured to receive a ball 640. In comparison to the expansion assembly 550 of FIG. 6, the bore 612 of the receptacle sleeve 610 has a smaller diameter section 620 for receiving the ball 640. In one embodiment, the ball 640 may be compressible such that is may be urged past the smaller diameter section 620 when sufficient pressure is applied. In one exemplary application, this embodiment is used to expand a tubular in a vertical well where a cementing job is not performed. In another embodiment, the bore 612 may have multiple sections having different diameters. In this respect, balls of different sizes may be received in the receptacle sleeve 610.

Figure 8:
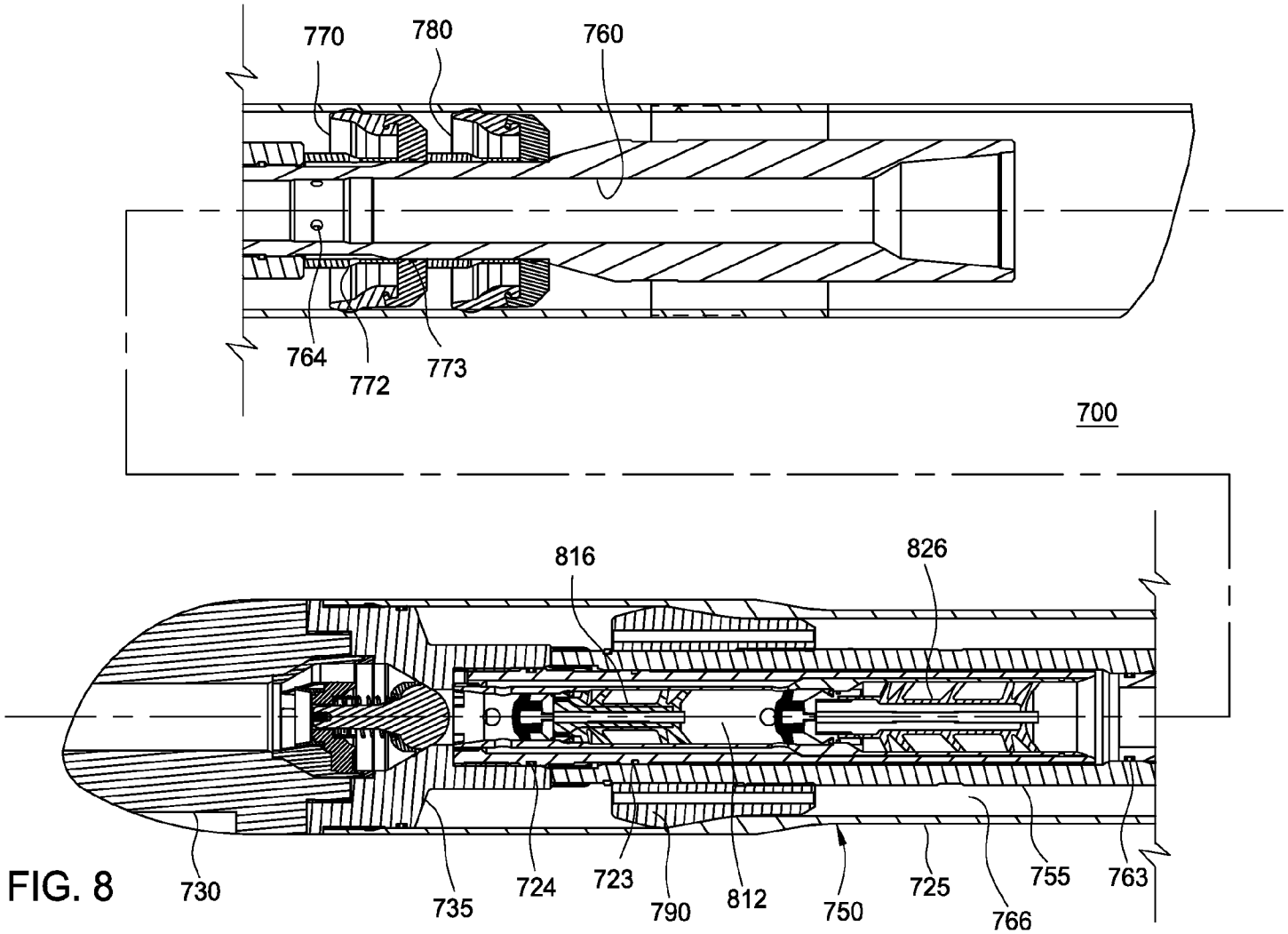
FIG. 8 illustrates another embodiment of an expandable tubular assembly.

FIG. 8 illustrates an embodiment of expansion assembly 750 configured to receive two darts. Because the receptacle sleeve is provided as a modular component, the expansion assembly 750 may be quickly reconfigured by attaching the appropriate receptacle sleeve. In this respect, the mandrel 755 and the tubular body section 735 may remain substantially the same. To provide a clearer description, components shown in FIG. 8 that are previously presented in FIG. 1 will not be described again in detail.

Figure 9:
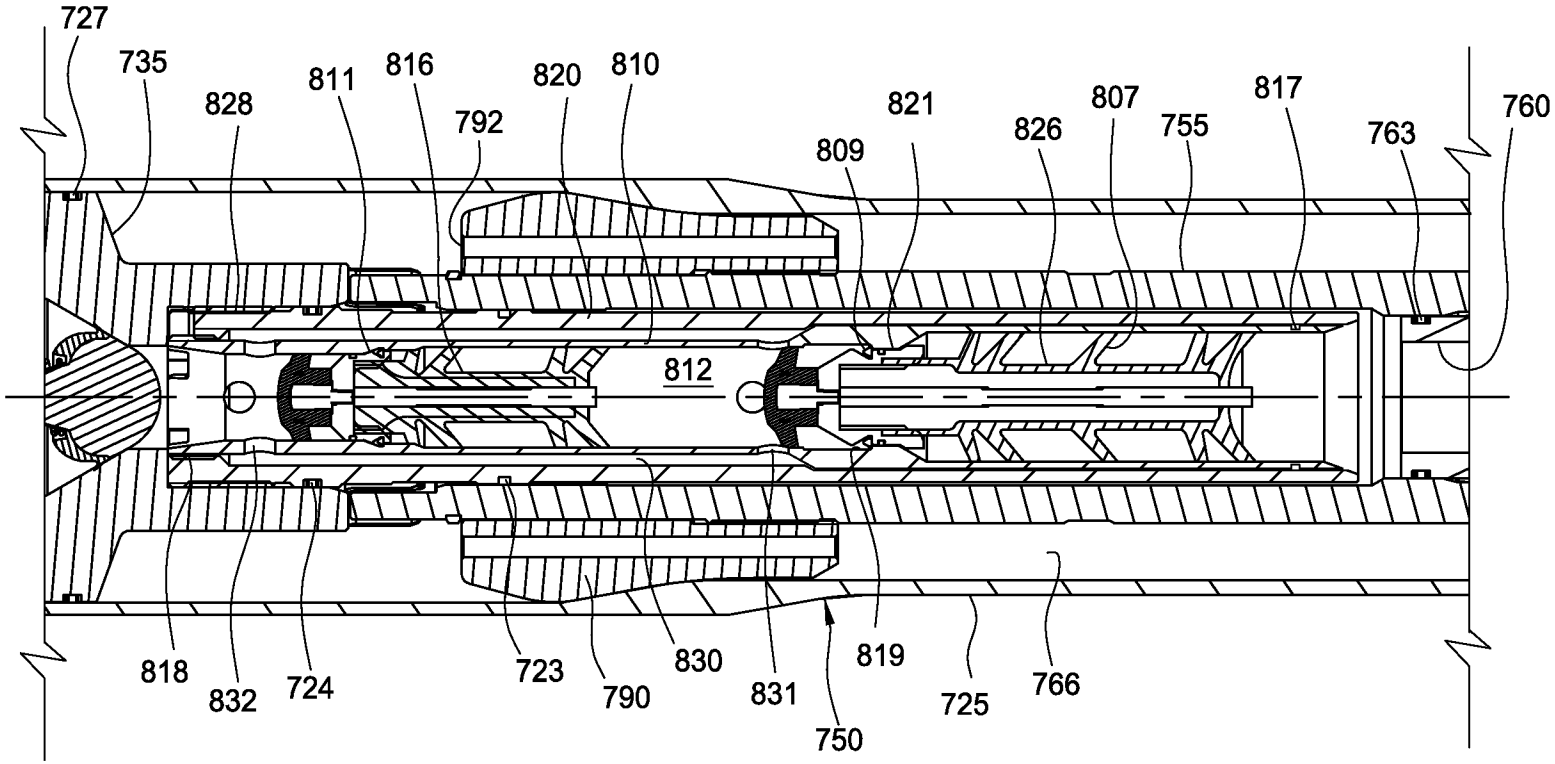
FIG. 9 is an enlarged partial view of the expandable tubular assembly of FIG. 8.

As shown in FIGS. 8 and 9, the expandable liner assembly 700 includes an expandable tubular 725 attached to the exterior of a tubular body section 735 and a nose 730 attached to the lower end of the tubular body section 735. FIG. 9 is an enlarged partial view of the liner assembly 700. A mandrel 755 is coupled to the tubular body section 735 and includes an expander 790 for expanding the tubular 725. The expander 790 may include a bypass channel 792 formed through the expander 790. A first packer 770 and an optional second packer 780 are coupled to the adapter sleeve 760, which in turn is connected to the upper end of the mandrel 755. The liner assembly 700 includes a first receptacle sleeve 810 connected to a second receptacle sleeve 820 at a lower end 818. For example, the first receptacle sleeve 810 may be threadedly connected to the second receptacle sleeve 820. In turn, the second receptacle sleeve 820 is connected to the tubular body section 735, such as by threads 828. The second receptacle sleeve 820 is located between the mandrel 755 and the first receptacle sleeve 810. The first receptacle sleeve 810 includes a lower seat 811 for receiving a first dart 816 and an upper seat 821 for receiving a second dart 826). A seal 723 such as an o-ring may be disposed between the second receptacle sleeve 820 and the mandrel 755. The seal 723 may be positioned on the second receptacle sleeve 820 or the mandrel 755. Another seal 724 may be disposed between the second receptacle sleeve 820 and the tubular body section 735. The seal 724 may be positioned on the second receptacle sleeve 820 or the tubular body section 735. The seals 723, 724, 727, 773, 763, and the packer 770 combine to define a sealed chamber 766 between the mandrel 755 and the expandable tubular 725 that fluidly communicates through the opening 772 and the port 764. A seal 817 may be disposed between the first and second receptacle sleeves 810, 820. The second receptacle sleeve 820 may be any suitable length. As shown, the first and second receptacle sleeves 810, 820 are approximately the same length, although each may be of different lengths. The lower end of the first and second receptacle sleeves 810, 820 may include castellations to prevent the formation of rings during drill out.

The bore 812 of the first receptacle sleeve 810 may be sized to receive the second dart 826 and sealingly engage with a wiper 807 on the second dart 826. The seat 821 may engage with a flange of the second dart 826 to limit downward movement of the second dart 826. Also, a latch 809 such as a c-ring may be provided on the second dart 826 to engage a recess 819 in the bore 812 to limit upward movement of the second dart 826. The bore 812 is sufficiently sized to allow the first dart 816 to pass through and land in the seat 811 of the first receptacle sleeve 810. A cement bypass 830 is provided between the first receptacle sleeve 810 and the second receptacle sleeve 820 to allow the cement or other fluid to flow around the first dart 816 after landing. In one embodiment, openings 831, 832 are provided above and below the seat 811 to form the cement bypass 830.

In another embodiment, the first receptacle sleeve 810 is connected to the second receptacle sleeve 820 at a lower end, which in turn, is connected to the to the tubular body section 735. However, the first receptacle sleeve 810 is configured to receive the first dart 816 and the second receptacle sleeve 820 is configured to receive the second dart 826. The first and second receptacle sleeves 810 and 820 may be configured to receive the darts 816, 826 in a similar manner as the first and second receptacles 410, 420 of FIG. 4.

Figure 10:
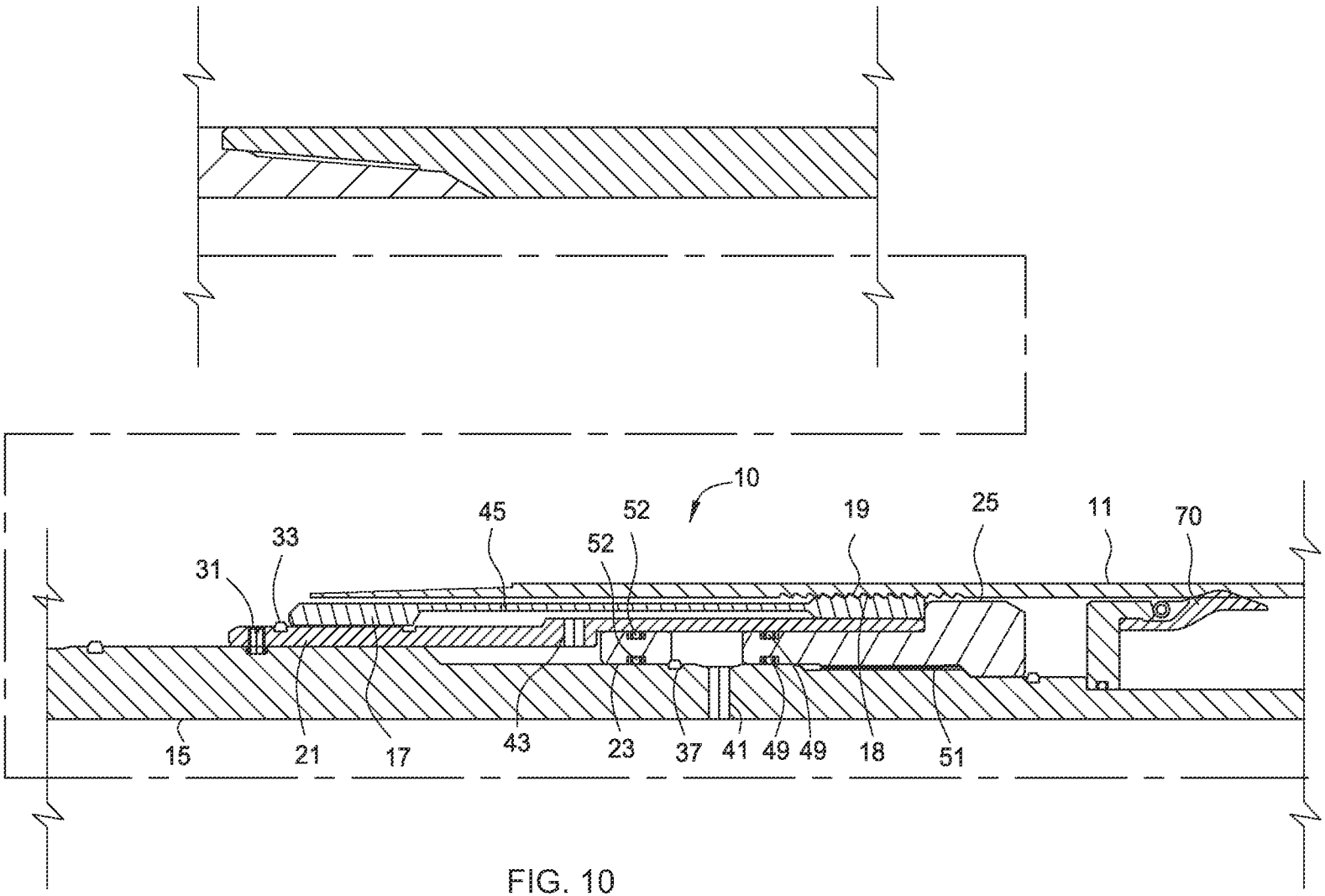
FIG. 10 depicts a running configuration for a liner release apparatus.

FIG. 10 illustrates a running configuration for an embodiment of a liner release apparatus 10. Embodiments of the release apparatus may be used with any suitable expandable assembly, such as any of the embodiments described herein, for example, FIG. 1. The release apparatus 10 has a profile designed for high load capacity. In one embodiment, the profile allows a conveyance string to carry a longer length of liner than is possible with conventional methods. The amount of pressure required to actuate the release apparatus and release the liner can be much lower than the internal pressure rating of the liner and liner connections. As such, the release apparatus 10 can run longer liner lengths at desired internal pressure without premature liner expansion or deformation, or relying on a thicker liner wall. Although embodiments depicted herein are in reference to expandable applications, it should be noted that the release apparatus described herein can be used for other applications, such as carrying a liner for non-expandable application or other types of tools.

The release apparatus 10 includes, a tubular body 15, a latching member 17 having a latching profile 18 engaged to a mating profile 19 in a liner 11, and a release sleeve 21 disposed around the tubular body 15. In one embodiment, the tubular body 15 may be connected to or integral with the tubular body of the expandable assembly. For example, with respect to the expansion assembly 150 shown in FIG. 5, the tubular body 15 may be integral with the adapter sleeve 160, the packer 70 may be one of the packers 170, 180, and the liner 11 may be the expandable tubular 125. The liner 11 and the release apparatus 10 are lowered into a wellbore (not shown) with the latching profile 18 engaged with the mating profile 19. The release sleeve 21 provides support to the latching member 17 so that the liner 11 and the latching member 17 stay engaged. In one embodiment, the release sleeve 21 can be disposed between the latching member 17 and the tubular body 15. The latching member 17 can be a collet or dogs that is biased inwardly. For example, the collets can be machined so that fingers of the collet can be bent inward absent a support such as the release sleeve 21 pushing the fingers outward. In another example, springs located on the dogs, facing a center line of the release apparatus 10 can pull the dogs toward the center line. The release sleeve 21 located inside the latching member 17 is configured to urge the latching member 17 outwards.

A support mandrel 25 connected to the tubular body 15 is configured to support the latching member 17 and the release sleeve 21. The mandrel 25 is disposed on one side of a port 41 of the tubular body 15. A flange on the exterior side of the mandrel 25 prevents the latching member 17 and the release sleeve 21 from moving downward with respect to the liner 11. Threads 51 may be used to secure the support mandrel 25 to the tubular body 15. A first seal 49 prevents fluid communication between the support mandrel 25 and the release sleeve 21, and a second seal 49 prevents fluid communication between the support mandrel 25 and the tubular body 15.

A piston 23 is located on the uphole side of the port 41. The piston 23 is sealably disposed around the tubular body 15 by o-rings 49. A third seal 52 prevents fluid communication between the support mandrel 25 and the release sleeve 21, and a fourth seal 52 prevents fluid communication between the support mandrel 25 and the tubular body 15. The port 41 provides fluid communication between a bore inside the tubular body 15 and the release apparatus 10. A snap ring 37 is positioned to the downhole side of the piston 23 and the uphole side of the port 41. The snap ring 37 prevents the piston 23 from downward movement. In another embodiment, the piston may be integral and movable with the release sleeve.

As shown, the release sleeve 21 is at least partially disposed around the piston 23 and the support mandrel 25. In addition to the support mandrel 25 limiting the release sleeve's 21 downward movement, the release sleeve 21 is secured around the tubular body 15 by a shearable member such as a shear pin 31. Other suitable shearable members may be used to connect and disconnect the release sleeve 21 from the tubular body 15. The release sleeve 21 may have an inner profile for engaging the piston 23 to allow the release sleeve 21 to be moved by the piston 23. The release sleeve 21 may have an outer profile for engaging the latching member 17 after the release sleeve 21 has been disconnected and moved to allow the latching member 17 to disengage from the liner 11. A stop member such as a snap ring 33 disposed on the release sleeve 21 initially prevents the upward movement of the latching member 17 relative to the liner 11 or the tubular body 15.

Figure 11:
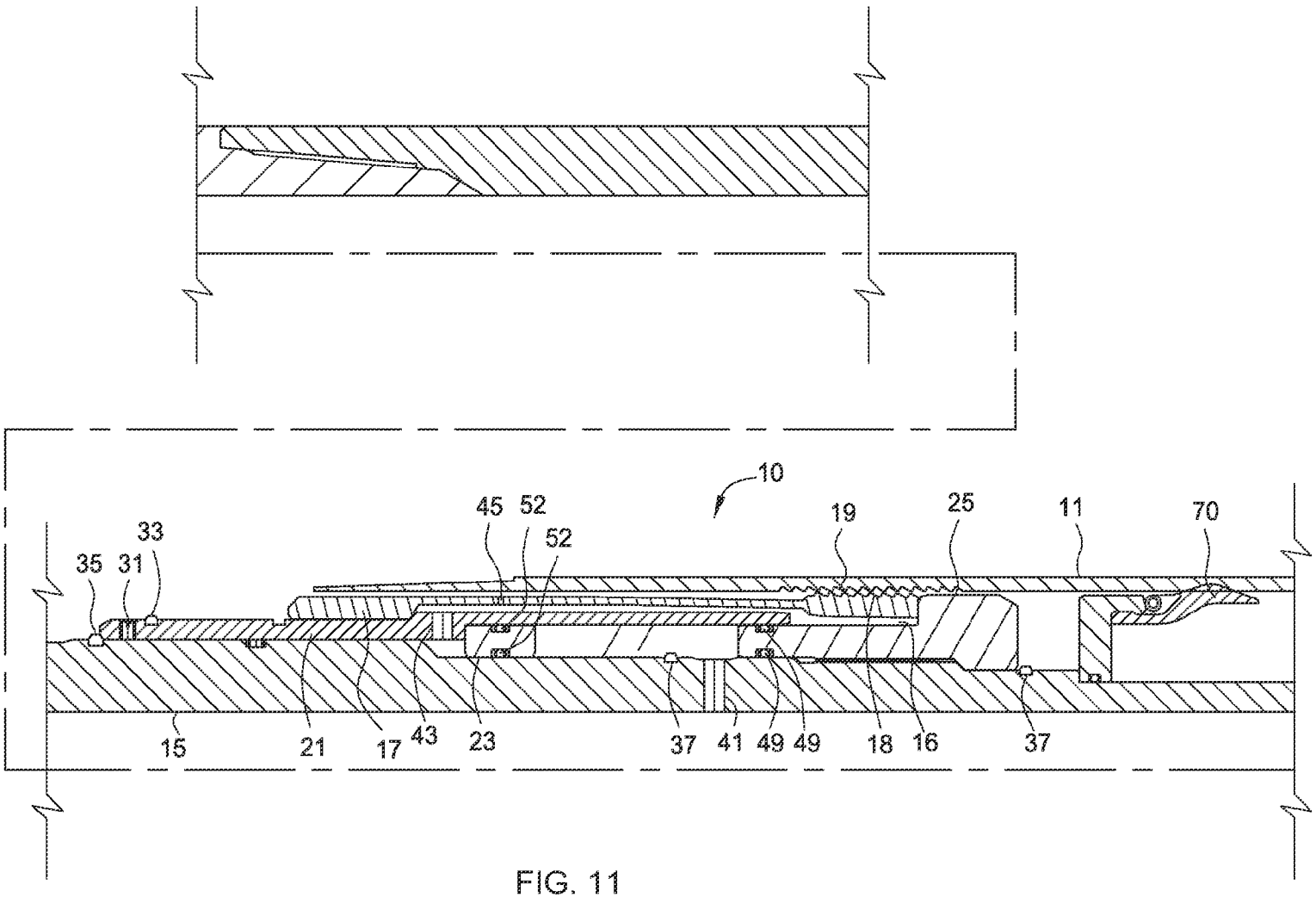
FIG. 11 depicts the liner release apparatus in a hydraulically released configuration.

In operation, as shown in FIG. 11, after the liner 11 is positioned at a target depth, preferably a ball or a dart is dropped in the expandable assembly carrying the liner 11, which plugs the lower end of the expandable assembly and isolates inner pressure from wellbore pressure. When the inner pressure increases, the fluid in the tubular body 15 communicates with the piston 23 through the port 41 and pushes the piston 23 against the release sleeve 21. The force exerted by the piston 23 shears the shear member 31 and moves the release sleeve 21 away from the latching profile 18, in this case, uphole. As shown, the release sleeve 21 is moved relative to the tubular body 15, while the tubular body 15 remains in position. The release sleeve 21 comes to a stop when it abuts the snap ring 35.

While the release sleeve 21 moves away from the latching member 17, the trapped fluid between the tubular body 15 and the release sleeve is drained through the port 43. Similarly, trapped fluid between the release sleeve 21 and the latching member 17 is discharged out through a port 43 in the release sleeve 21 and a port 45 in the latching member 17. After the release sleeve 21 moves upward relative to the latching member 17, the release sleeve 21 no longer abuts the latching profile 18 of the latching member 17. As a result, the latching profile 18 is allowed to retract into the space 16 vacated by the release sleeve 21. In turn, the latching profile 18 disengages from the mating profile 19 of the liner 11. In one embodiment, the release of the liner 11 is accomplished without axial movement of the tubular body 15 relative to the liner 11. After the latching member 17 disengages from the liner 11, the release apparatus 10 is free to move relative to the liner 11. In one embodiment, when fluid pressure is applied to the packer 70, the expander 190 is free to move upward to expand the liner 11. The release apparatus 10 can be retrieved along with the expander 190 after expansion.

Figure 12:
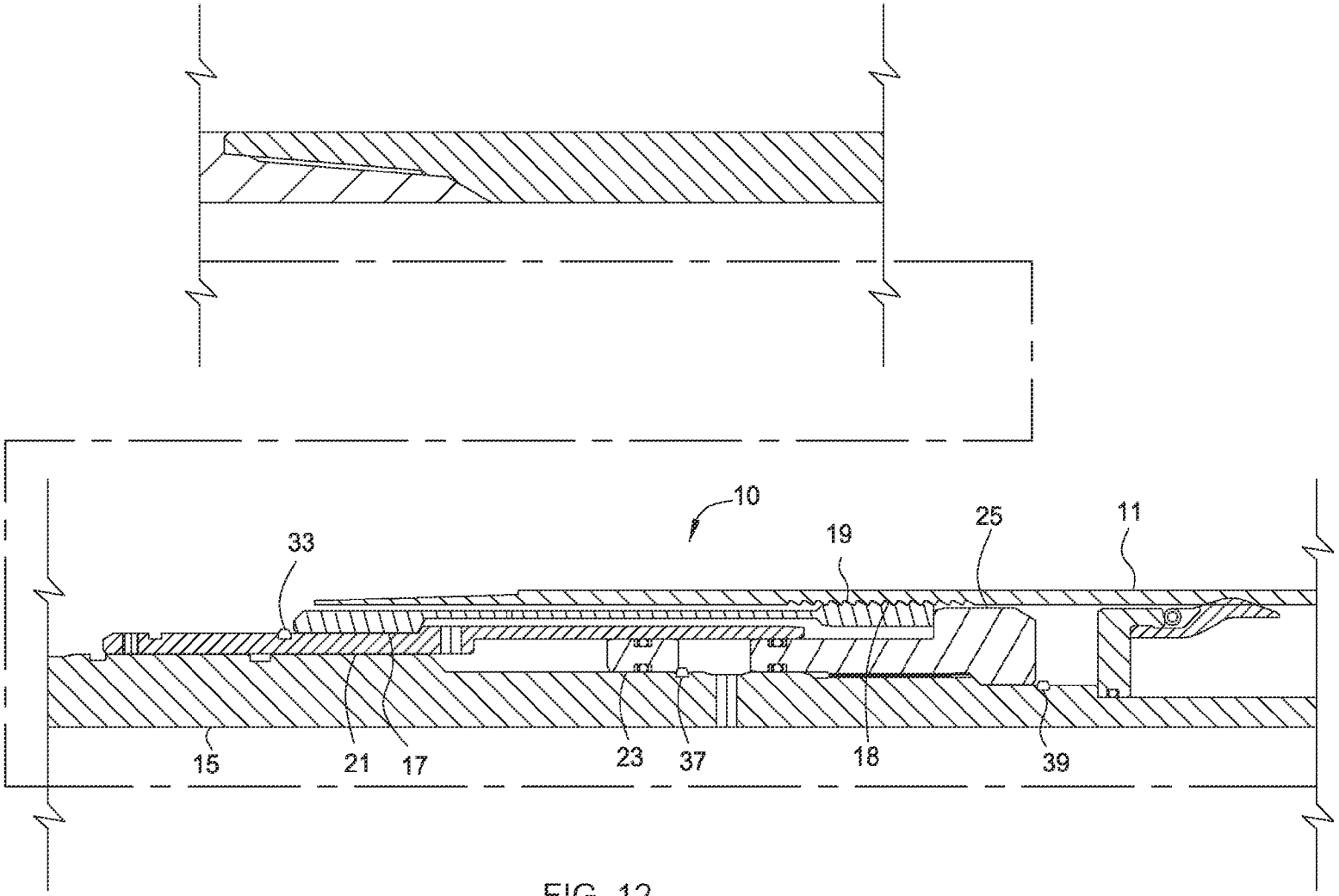
FIG. 12 depicts the liner release apparatus in a partially assembled configuration.

Referring to FIG. 12, the release apparatus 10 can be assembled by positioning the piston 23 and the support mandrel 25 around the tubular body 15 from one end of the lower end of the tubular body 15. The latching member 17 and the release sleeve 21 can be positioned around the tubular body 15 from the other end of the tubular body 15. During insertion into the liner 11, an optional position indicator 33 can prevent the release member 21 from sliding past the latching profile 18, thereby prematurely locking the release apparatus 10 to the liner 11. After the latching member 17 abuts the support mandrel 25, the position indicator 33 can be removed from the latching member 17, thereby allowing the release sleeve 21 to move underneath the latching profile 17 to lock the release apparatus 10 to the liner 11.

Figure 13:
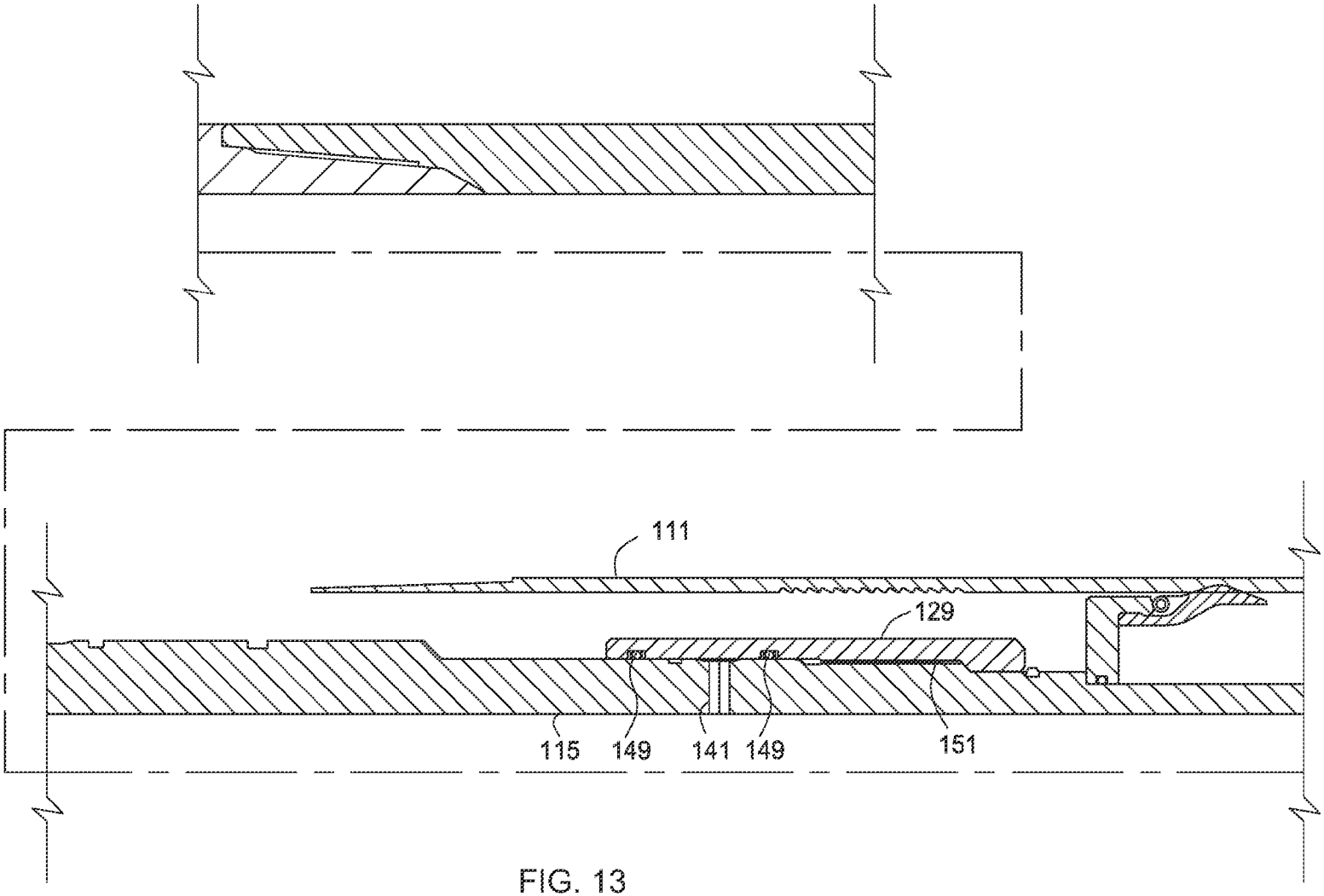
FIG. 13 depicts a short sleeve disposed around a tubular body.

FIG. 13 illustrates an exemplary embodiment of the release apparatus 10 configured for running shorter lengths of a liner 111. A cover sleeve 129 coupled to a tubular body 115 may be used to block fluid communication through the port 141 by using seals 149. In one embodiment, the cover sleeve 129 is coupled to the tubular body 115 using threads. In this configuration, the short sleeve 129 is threaded to the outer surface of the tubular body 115 and located inside the liner 111.

In one embodiment, a liner release apparatus includes, a tubular body, a latching member having a latching profile engaged to a mating profile in the liner, and a release sleeve disposed around the tubular body and operable to allow the latching profile to radially collapse to disengage the latching member from the liner.

While the foregoing is directed to embodiments of the present invention, other and further embodiments of the invention may be devised without departing from the basic scope thereof, and the scope thereof is determined by the claims that follow.

The invention claimed is:

1. A method of lining a wellbore, comprising:

lowering an expandable liner and an expansion assembly into the wellbore using a running string and a release apparatus, the release apparatus having:

a latching member engaged with a profile of the expandable liner, thereby transferring weight of the expandable liner to the running string, and a piston;

releasing an obstruction object into the running string and landing the obstruction object into a receptacle of the expansion assembly; and pressurizing a bore of the expansion assembly and the release apparatus against the landed obstruction object, thereby:

operating the piston to release the latching member from the profile, pressurizing a chamber formed between the expansion assembly and the expandable liner to urge an expander thereof upward through the expandable liner, and expanding the liner inside the wellbore.

2. The method of claim 1, further comprising rotating the expandable liner during lowering thereof into the wellbore, wherein pressurizing the bore also torsionally disconnects the expandable liner from the running string.

3. The method of claim 1, further comprising cementing the expandable liner into the wellbore.

4. The method of claim 1, further comprising drilling out the receptacle and the obstruction object.

5. The method of claim 1, wherein, during lowering, the expandable liner has a lower enlarged portion and an upper unexpanded portion and the expander is positioned at a transition therebetween.

6. The method of claim 1, wherein:

the release apparatus further has a release sleeve locking the latching member into engagement with the profile and a shearable member restraining the release sleeve, and the piston releases the latching member by exerting force on the release sleeve to fracture the shearable member and axially move the release sleeve away from the latching member.

* * * * *